US011850487B2

(12) United States Patent
Marvin

(10) Patent No.: US 11,850,487 B2
(45) Date of Patent: Dec. 26, 2023

(54) PUTTRAIL

(71) Applicant: Craig John Marvin, Madison, WI (US)

(72) Inventor: Craig John Marvin, Madison, WI (US)

( * ) Notice: Subject to any disclaimer, the term of this patent is extended or adjusted under 35 U.S.C. 154(b) by 0 days.

(21) Appl. No.: 17/712,713

(22) Filed: Apr. 4, 2022

(65) Prior Publication Data

US 2023/0310961 A1 Oct. 5, 2023

(51) Int. Cl.

| | |
|---|---|
| ***A63B 67/02*** | (2006.01) |
| ***A63B 69/36*** | (2006.01) |
| *A63B 63/00* | (2006.01) |

(52) U.S. Cl.

CPC ..... *A63B 67/02* (2013.01); *A63B 69/3676* (2013.01); *A63B 2063/001* (2013.01); *A63B 2067/025* (2013.01)

(58) Field of Classification Search

CPC ... A63B 57/40; A63B 2063/001; A63B 67/02; A63B 69/3676

See application file for complete search history.

(56) References Cited

U.S. PATENT DOCUMENTS

| | | | | |
|---|---|---|---|---|
| 4,437,669 | A * | 3/1984 | Pelz | A63B 69/36211 473/265 |
| 4,828,267 | A * | 5/1989 | Goodrich | A63B 47/00 473/160 |
| 7,666,107 | B2 * | 2/2010 | Sorenson | A63B 69/3621 473/226 |
| 10,940,378 | B1 * | 3/2021 | Offerman | A63B 57/40 |
| 2015/0031465 | A1 * | 1/2015 | McWilliam | A63B 67/02 473/160 |

* cited by examiner

*Primary Examiner* — Laura Davison

(57) ABSTRACT

A consumer apparatus that golfers of any level may use to practice their putting stroke mainly in an indoor environment. The putting practice device requires the user to propel the golf ball on top of a set of parallel rails up a slope and into one of different cup holes. Each hole has a door which may be opened and/or closed. The doors also have rails that let the golf ball continue up the slope to the hole of the user's choice. This lets the user practice hitting different lengths of putts in a short space.

1 Claim, 4 Drawing Sheets

Top View of assembled product.
Right-Handed operation.

Fig 1 Side view.

Top view of each section of the product.

Top View of assembled product.
Right-Handed operation.

Top view of assembled product.
Left-handed operation.

PUTTRAIL

BACKGROUND OF THE INVENTION

A device for golfers to practice different distance of putts. It can also be used as a form of entertainment for consumers to use in their offices, break rooms, home play areas or even at tailgate parties and other gathering places.

Golfing is a popular sport around the world and millions of men and women put in millions of "rounds of golf" every year. A few thousand reach the professional level and thousands more are teaching professionals of golf. Millions more are considered amateurs of varying levels and play golf for fun, entertainment, and exercise. A golfer must learn to hit or "stroke" a variety of clubs (woods, irons, wedges, and putters) as they play each of their rounds of golf. Each stroke counts in a golfer's score, and the idea is to take the least number of strokes as possible. A round of golf usually consists of 9 or 18 holes on a golf course. Each hole has a green which is a specific area of a golf course that golfers will use a specific club, the Putter. Most golf courses have a practice green specifically used for practicing the putting stroke. However, many devices and products have been developed to help golfers practice their putting indoors. They concentrate on aiming, correct swing angles, following contours, etc. Many products are made of carpeting to simulate the green grass of a golfing green, and some even have slight elevations and a return gutter. Most of these products seem to concentrate on aiming of the golf ball and the proper swinging motion of the putter. However, if you watch teaching videos or listen to golf teaching professionals one of the most important aspects of hitting a good putt is the speed of the putt. Some have said the three most important aspects of a putt are No. 1 Speed, No. 2 Speed and No. 3 speed. Even if a golfer has a "good" putting stroke and has good aiming skills the speed of the putt is extremely critical in achieving the putting objective of putting the ball in the cup or nearest to the hole as possible. It would be safe to say that every golfer would like to be able to hit every putt at the correct speed. Practicing the hitting speed of putts is this invention's purpose. It will let a golfer practice hitting different speed putts up the slope to different holes, thereby teaching that golfer through muscle memory how hard or soft to hit different distance putts. The return channel and gutter let the golfer stand in one place and make putt after putt giving them many opportunities in a short period of time to practice their putting speeds and putting stroke.

BRIEF SUMMARY OF THE INVENTION

A golfers training aid that can be used by anyone to practice hitting putts within a small 6-7-foot area that simulates much longer putts by having the golf ball travel along two parallel rails up a slope with many holes at different distances and having the golf balls return to the beginning of the device down a gutter for their next practice putt.

DETAILED DESCRIPTION OF THE INVENTION

Figure 1:
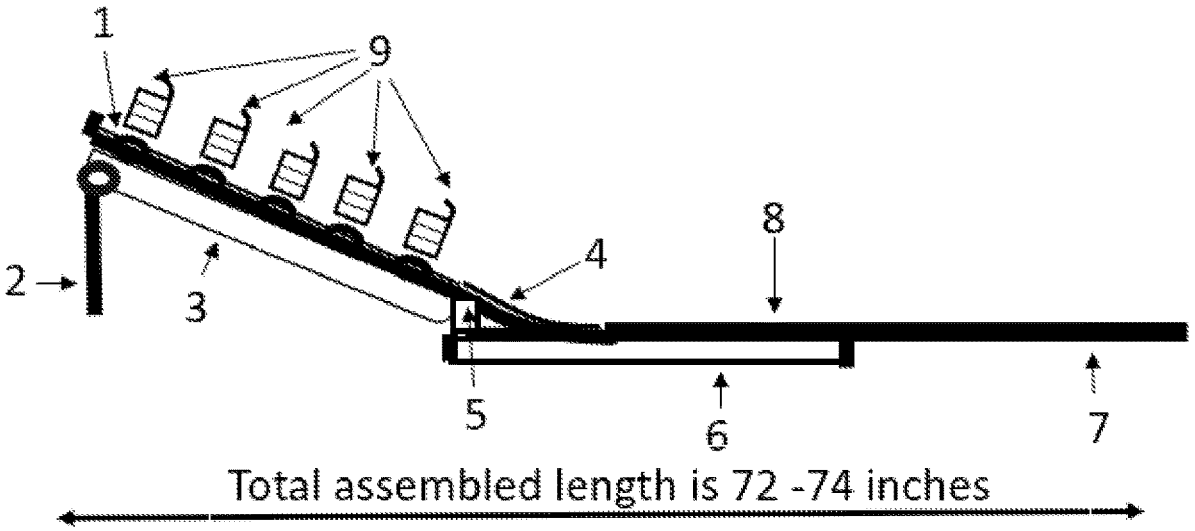
FIG. 1 is a side view of the PuttRail showing the flat rail where the golfer would begin the putt that then leads to the upper slope piece.
Figure 2:
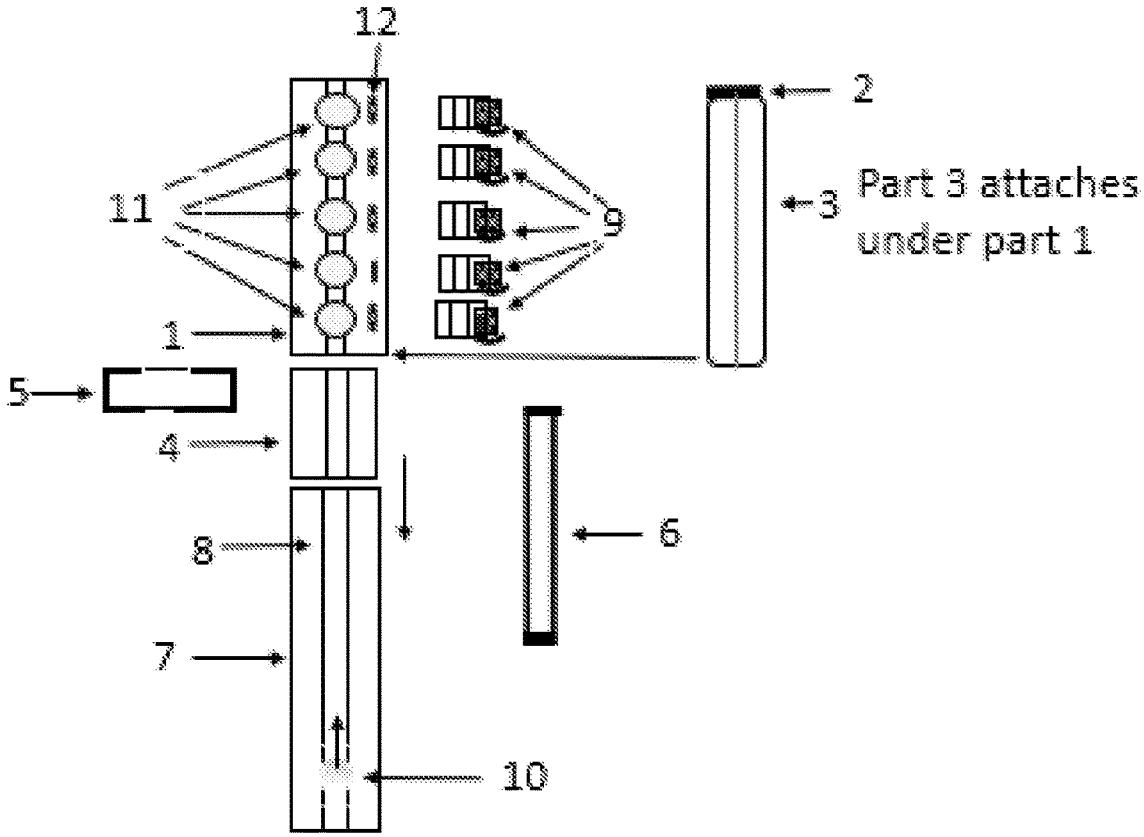
FIG. 2 is a view from the top which shows all the pieces of the PuttRail that need to be assembled for proper operation of the device.
Figure 3:
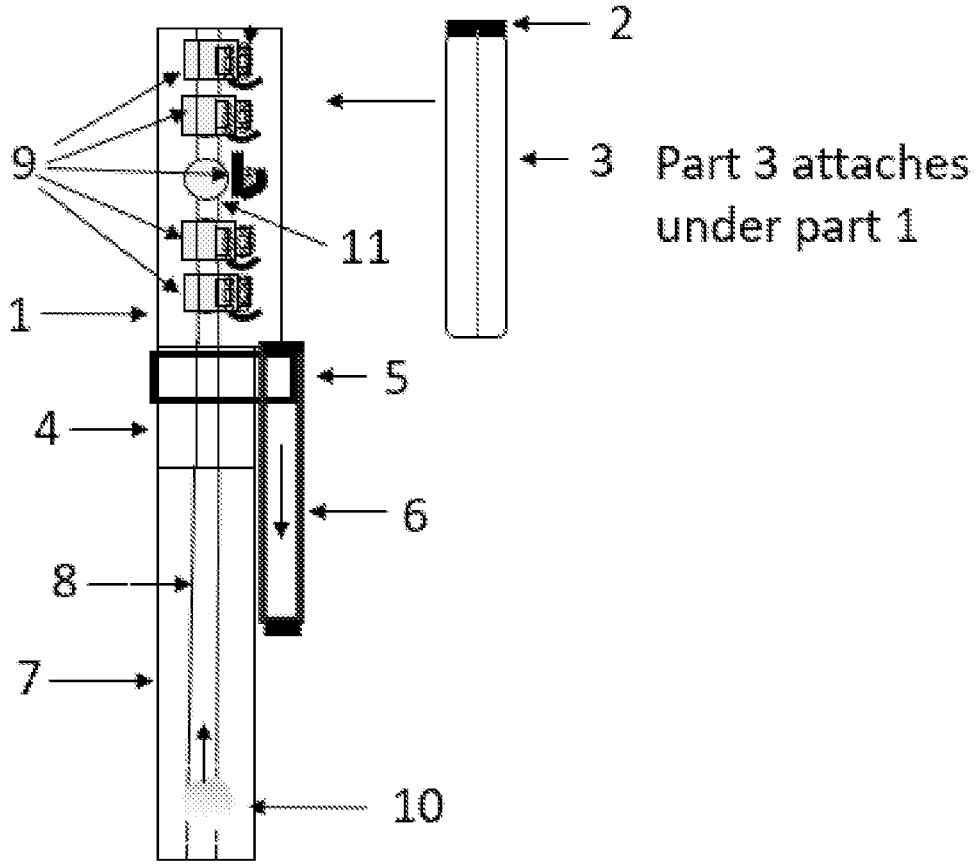
FIG. 3 shows the device as used by a right-handed golfer.
Figure 4:
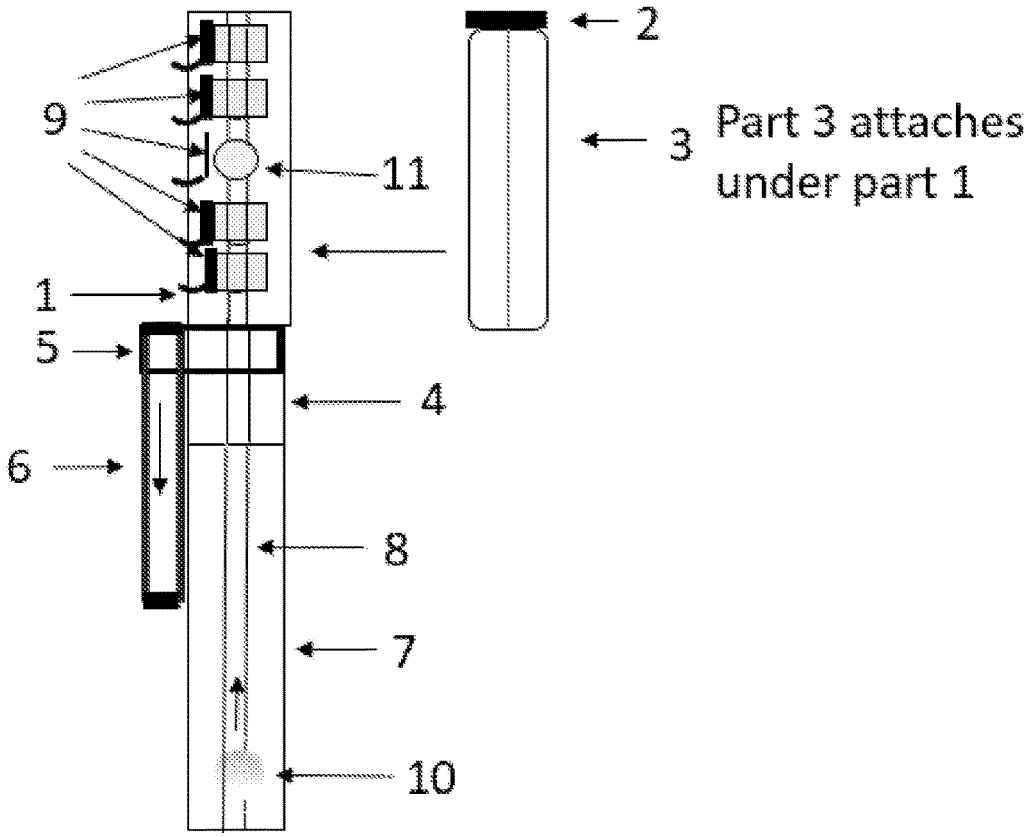
FIG. 4 shows the device as used by a left-handed golfer.

A golfers' speed training device for practice or recreational putting (mostly indoors but can be used outdoors also). The product is to be placed on the floor or ground where a person may stand over the product and using a golf putter and golf ball (not part of the product) make a golf putting stroke hitting the ball along a set of rails. It consists of two parallel rails that are approximately 1¼ inches apart that follow a flat straight path for a few feet and then begins an upward slope to several holes (cups) at varying distances up the slope. Each hole has a door that can open and close with the two parallel rails continuing over each cup door to achieve different heights up the slope therefore requiring a different speed of putt to reach each cup. Once the golf ball is holed at the proper distance the ball drops into a tube under the device and is returned down a gutter to the beginning of the rail and can be placed back on the rail for the next practice putt.

The intent of the device is to train golfers in hand and eye coordination and achieve the correct feel for the proper speed for putting different distances. Another benefit of the device is the golf ball is placed on top of two parallel rails so that the putt must be struck in a smooth and proper motion, so the ball does not leave the rails. This may also help golfers of any skill level improve their putting stroke.

The PuttRail device can also be easily configured (adjusted) to accommodate putting from each side so that either right- or left-hand golfers can use the device with the gutter on the opposite side for their convenience.

No other putting training device uses the rail techniques or the many different hole distances allowing a golfer to practice hitting different speeds. It is mainly to be used indoors so a person can practice putting anytime and any weather.

PuttRail is to be assembled in different sections as detailed in the including figure drawings. It could be made of different materials but hard plastic the color of green would be the preferred material. The pieces would be molded so that they can be assembled or snapped together into the final working product.

The differing section include:

Section 1. The upward slope rail cup hole piece. Approximately 28 inches, with two-inch cup holes equally placed apart about 2½ inches. This piece will have indents at the hole locations to accommodate the width of the cup hole doors. The doors will have to fit into the indents and have the rails at the same height as the other rails to accommodate the smooth roll of the golf ball. It will also have hinge pin attachments so the doors may be snapped into place and accommodate opening and closing of the doors. Section 1 will be detachable, and 180 degrees interchangeably snapped into section 3 to accommodate for right or left-handed putting. The golf holes will have channel pieces underneath to guide the golf ball to the correct return channel feeding to the right- or left-handed return gutter piece placement.

Section 2. The support leg will be 12-13 inches and will snap into section 3 and be rotatable to close into storage position.

Section 3. Return channel piece underneath section 1 will be the tube or channel that the golf balls will roll back down to the return gutter piece. It will have connections to accommodate snapping section 1 into place on top of section 3.

Section 4. Transition curved rail piece approximately 10 to 12 inches. Curved to join section 1 and section 7 and accommodate the rolling of the golf ball up the slope. This part will have a sliding insert underneath to channel the ball to the gutter on the side of choice for lefthanded or right-handed putting.

Section 5. Sliding insert into section 4.

Section 6. The return gutter will be attachable to the flat rail section 7 and run alongside that flat rail and the transition curved section 4 to accommodate the golf ball returning towards the beginning of the flat rail for the next putt. It will be symmetrical so that it may be affixed on either side of the side rail for right- or left-handed putting.

Section 7. Flat rail piece approximately 3 feet. It will accommodate the gutter attachment on either the left or right side. It will be attachable to section 4 with the rails running smoothly up section 4 and along section 1 and on the back side of the doors. The rails throughout the entire PuttRail will be 1¼ inches apart at the top of the rail to accommodate the rolling of the golf ball on top of the rails.

Section 8. Rails spaced 1¼ inches apart.

Section 9. The cup hole doors. There will be hinged doors that open and close over the holes. They will snap into place at the hinges. The entire section 1 will be symmetrical and can be snapped into place so the cup hole doors will open on either the left or right side. The cup hole door pieces will have a handle lever to operate the opening and closing of the doors.

All sections will be made to be assembled (snapped or inserted) together or unassembled and therefore easily boxed for shipping, storage or fit in a bag for travel or moving the device. The approximate length of final assembled product to be around 6 feet long. Width will be under 6 inches wide.

FIGURE DESCRIPTIONS

FIG. 1

PuttRail Side View

Upward Slope Rail piece with a variety of cup holes is approximately 28 inches long and symmetrical so that it can be snapped into return channel with doors on right or left side. Cup holes are equally placed up the slope and the rail will have indentations to accommodate the cup doors when lying flat, so the rails are smooth all the way to the last cup hole.

Support leg that snaps into return channel. Rotatable to fold up under channel. Return channel. Upward slope rail piece snaps into return channel.

Transition curved rail piece 12-14 inches. Attachable to upward slope rail and flat rail. Bottom of curved piece has sliding insert that directs into the gutter on the left or right side.

Return Gutter is symmetrical so can placed on left or right side. Attaches to flat rail. Flat rail piece approx. 36 inches long. Hinged or detachable from the transition curved piece.

Rails 1¼ inches apart in the center of the flat rail and curved transition rail. Rail will continue up to the upward slope rail and over the back of the doors.

A variety of railed cup hole doors hinged to open and close over cup holes. With two-piece rail on each door and with levers for using putter to open and close.

FIG. 2

PuttRail Top View of Each Separate Section

Upward slope rail piece. Each cup hole area will have a depression equal to the railed cup hole doors to ensure the rails are at the exact height of the other two rail pieces when the doors are closed ensuring a smooth "roll" of the golf ball along the rails. This piece is symmetrical and can be snapped into the return channel piece below with doors opening either on the left or right side. Each hole has a guide piece underneath to direct the ball to the correct side of the return channel.

Ball stopper and support leg.

Return channel attachable under the upward slope piece. Guides the ball either left or right.

Transition curved rail piece.

Slidable insert piece as part of the curved transition rail to direct golf ball either left or right depending on where the user wants the gutter.

Return gutter to accommodate golf ball returning to the putting start area. Is symmetrical so it may be turned 180 degrees and attach to flat rail piece on either left or right side.

Flat rail piece. Rails are ¼ inch high and 1¼ of an inch apart at the top of the rail to accommodate a rolling golf ball. Rails continue up the curved transition and upward slope rails.

Rails 1¼ inches apart in the center of the flat rail and curved transition rail. Rail will continue up to the upward slope rail and over the back of the doors.

A variety of railed cup hole doors hinged to open and close over cup holes. With two-piece rail on each door and with levers for using putter to open and close.

Golf ball (not part of product). To be rolled (putted) along the rail.

The Cup Holes 2 inches round. Ball drops through hole in to return channel below.

The Hinge Holes for installation of railed cup doors.

FIG. 3

PuttRail Top View of Assembled Product. Right-Handed Operation.

Upward slope rail piece. Each cup hole area will have a rectangular depression equal to the railed cup hole doors to ensure the rails are at the exact height of the other two rail pieces when the doors are closed ensuring a smooth "roll" of the golf ball along the rails. This piece is symmetrical and can be snapped into the return channel piece below with doors opening either on the left or right side. Each hole has a guide piece underneath to direct the ball to the correct channel. This figure shows the upward slope rail piece in the position for a right-handed golfer.

Ball stopper and support leg.

Return channel attachable under the upward slope piece. Guides the ball either left or right.

Transition curved rail piece.

Slidable insert piece as part of the curved transition rail to direct golf ball either left or right depending on where the user wants the gutter.

Return gutter to accommodate golf ball returning to the putting start area. Is symmetrical so it may be turned 180 degrees and attach to flat rail piece on either left or right side. This position is for a right-handed golfer.

Flat rail piece. Rails are ¼ inch high and 1¼ of an inch apart at the top of the rail to accommodate a rolling golf ball. Rails continue up the curved transition and upward slope rails.

Rails 1¼ inches apart in the center of the flat rail and curved transition rail. Rail will continue up to the upward slope rail and over the back of the doors.

A variety of railed cup hole doors hinged to open and close over cup holes.

With two-piece rail on each door and with levers for using putter to open and close.

Golf ball (not part of product). To be rolled (putted) along the rail.

Example: The third Cup Hole open and available for the golf ball if hit the correct distance to drop through and into the return channel, and down to the slidable insert piece and on to the return gutter. In this instance the golf ball travels over the flat rail, the transition curved rail piece upwards to and over the rails of doors 1 and 2. Opening and closing each of the doors will allow the Putter to hit the ball the correct speed and distance across each closed door to reach the desired cup hole.

FIG. 4

PuttRail Top View of Assembled Product. Left-Handed Operation.

Upward slope rail piece. Each cup hole area will have a rectangular depression equal to the railed cup hole doors to ensure the rails are at the exact height of the other two rail pieces when the doors are closed ensuring a smooth "roll" of the golf ball along the rails. This piece is symmetrical and can be snapped into the return channel piece below with doors opening either on the left or right side. Each hole has a guide piece underneath to direct the ball to the correct channel. This figure shows the upward slope rail piece in the position for a left-handed golfer.

Ball stopper and support leg.

Return channel attachable under the upward slope piece. Guides the ball either left or right.

Transition curved rail piece.

Slidable insert piece as part of the curved transition rail to direct golf ball either left or right depending on where the user wants the gutter.

Return gutter to accommodate golf ball returning to the putting start area. Is symmetrical so it may be turned 180 degrees and attach to flat rail piece on either left or right side. This position is for a left-handed golfer.

Flat rail piece. Rails are ¼ inch high and 1¼ of an inch apart at the top of the rail to accommodate a rolling golf ball. Rails continue up the curved transition and upward slope rails.

Rails 1¼ inches apart in the center of the flat rail and curved transition rail. Rail will continue up to the upward slope rail and over the back of the doors.

A variety of railed cup hole doors hinged to open and close over cup holes. With two-piece rail on each door and with levers for using putter to open and close.

Golf ball (not part of product). To be rolled (putted) along the rail.

Example the third Cup Hole open and available for the golf ball if hit the correct distance to drop through and into the return channel, and down to the slidable insert piece and on to the return gutter. In this instance the golf ball travels over the flat rail, the transition curved rail piece upwards to and over the rails of doors 1 and 2. Opening and closing each of the doors will allow the Putter to hit the ball the correct speed and distance across each closed door to reach the desired cup hole.

CITED PATENTS

U.S. Pat. No. 7,666,107 B2
US 2015/0031465 A1
U.S. Pat. No. 4,437,669 A

The invention claimed is:

1. A practice putting apparatus comprising:

two parallel rails extending along a flat surface and curving up to an upward slope wherein the rails are configured to support a ball rolling on top of the rails;

a plurality of cup holes formed in the upward slope at different distances from a first end of the rails, each cup hole having a door that can be opened and closed, and each door having two parallel rail sections on a back side of the door which are configured to support the ball rolling on top of the rail sections when the door is closed;

and a channel underneath the rails configured to direct a ball that has been received in one of the cup holes to a return gutter to return the ball in a direction toward the first end of the rails.

* * * * *